United States Patent [19]

Gould

[11] Patent Number: 4,938,136

[45] Date of Patent: Jul. 3, 1990

[54] RESONANT ACOUSTICMAGNETIC MINISWEEPER

[75] Inventor: Paul F. Gould, Panama City, Fla.

[73] Assignee: The United States of America as represented by the Secretary of the Navy, Washington, D.C.

[21] Appl. No.: 651,489

[22] Filed: Jan. 19, 1976

[51] Int. Cl.[5] ..... F42B 22/00

[52] U.S. Cl. ..... 102/406; 102/401; 102/402; 181/142; 367/1; 367/142; 367/173

[58] Field of Search ..... 102/18 MS, 401, 402, 102/406; 340/5 D; 114/221 R, 235 R, 235 B; 181/108, 109, 110, 111, 121, 142; 367/1, 106, 130, 141, 142, 168, 173, 910

[56] References Cited

U.S. PATENT DOCUMENTS

| | | | |
|---|---|---|---|
| 2,395,862 | 3/1946 | Freeman et al. | 102/18 MS |
| 2,548,905 | 4/1951 | Odenweller et al. | 102/18 MS |
| 3,319,735 | 5/1967 | Hayes et al. | 340/5 D |
| 3,826,215 | 7/1974 | Dyjak | 102/18 MS |
| 3,833,880 | 9/1974 | Abbott | 114/235 B |
| 3,906,884 | 9/1975 | Gould | 102/18 MS |

*Primary Examiner*—Charles T. Jordan
*Assistant Examiner*—Rochelle Lieberman
*Attorney, Agent, or Firm*—Sol Sheinbein; John Becker; Harvey David

[57] ABSTRACT

A system for sweeping acoustic and magnetic mines or a combination of both is disclosed as comprising a pair of spatially disposed magnetic pipes that are held in their respective spatial dispositions by front and rear straps, and an acoustical energy generating pipe suspended between said front and rear straps by hinges in such manner that it is also disposed between said pair of spatially disposed magnetic pipes. A tractor vehicle moves all of the aforesaid pipes and their associated elements as a unit along a course intended to be cleared of acoustic and/or magnetic mines.

6 Claims, 1 Drawing Sheet

RESONANT ACOUSTICMAGNETIC MINISWEEPER

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention, in general, relates to acoustical and magnetic energy sources and, in particular, is a generator for simultaneously producing a combination of high power, low frequency acoustical and predetermined magnetic energies within one or more environmental mediums. In even greater particularity, the subject invention comprises a mobile systems which generates acosutical and magnetic energy in a unique manner for the purpose of sweeping acoustic and magnetic marine and other mines.

DESCRIPTION OF THE PRIOR ART

Heretofore, numerous sound sources (sonic and ultrasonic) and numerous magnetic, electromagnetic, and electrostatic energy sources have been employed to sweep mines. For example, electrical and electronic generators which energize electroacoustical transducers have been used for such purpose. Moreover, such devices as permanently magnetized pipes and electrically energized electromagnets and electrodes have generated magnetic, electromagnetic, and electrostatic fields, respectively, which were then broadcast throughout a given subaqueous or other environmental medium, in order to sweep marine and other mines. Furthermore, even sophisticated sonar systems have been used for minesweeping purposes. Hence, it may readily be seen that the magnetic and acoustic minesweeping arts are crowded, indeed.

Of course, the devices of the aforementioned prior arts have, for many practical purposes, been found to be quite satisfactory; however, there still remains a specific need for improved minesweeping devices and systems, especially with respect to those that simultaneously sweep—that is, cause to be self-destroyed in response to received predetermined energy—acoustic and magnetic mines during the single traverse of any given path intended to be cleared thereof.

SUMMARY OF THE INVENTION

The instant invention overcomes a number of the disadvantages of the known prior art, in that it constitutes a relatively simple, efficient, economical, and effective method and means for neutralizing low frequency acoustic-magnetic combination mines, as well as other individual acoustic and magnetic energy responsive mines and other similary responsive devices, such as, for example, various and sundry torpedoes. Simply put, the subject invention consists of a unique combination of permanently magnetized pipes and a new and unusual resonant pipe sonic generator, the bending of which is uniquely accomplished and produces acoustical energy within water or the other environmental medium ambient thereto.

Therefore, an important object of this invention is to provide an improved acoustic-magnetic minesweeper.

Another object of this invention is to provide an improved method and means for sweeping acoustic mines, magnetic mines, or a combination of both while making a single traverse over a path within responsive range thereof.

Another object of this invention is to provide an improved acoustical energy generator.

Another object of this invention is to provide an improved method and means of broadcasting magnetic energy.

Still another object of this invention is to provide a simple but efficient method and means for producing sonic energy with very low frequencies—say, between two and thirty Hertz—at high power.

A further object of this invention is to provide a low frequency, high power sonic generator that is not bulky, unwieldy, or structurally complicated, but which may be easily and economically constructed, operated, disassembled and assembled, maintained, transported, and stored.

A further object of this invention is to provide an improved minesweeping system that is susceptible to being moved, towed, or pushed by many different tractor vehicles, such as boats, ships, helicopters, submarine vehicles, land vehicles, space vehicles, air vehicles, or the like, inasmuch as the horsepower requirements therefor are low and the drag thereof is minimal.

Still another object of this invention is to provide an improved minesweeping system that is light in weight and, thus, may readily be maneuvered in tight spots and shallow water—in water as shallow as one foot, for instance.

Another object of this invention is to provide an improved acoustic-mangetic generator that may be used as a torpedo decoy.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
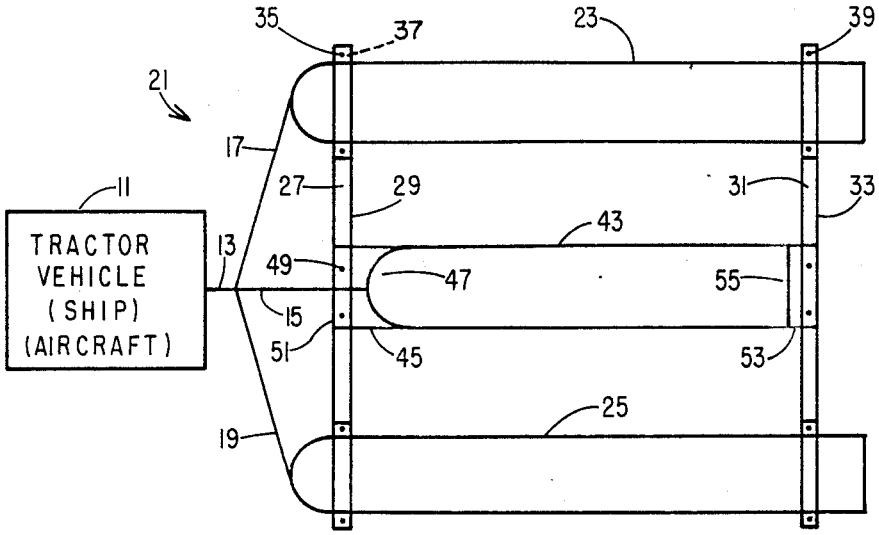
FIG. 1 depicts, in block and schematic form, a top view of the improved minesweeping system constituting this invention.

Referring now to FIG. 1, there is shown a tractor vehicle 11 which, for the purposes of this invention, may be anything that will work in the environment involved to push or pull the minesweeping device of this invention. For instance, as previously suggested, tractor vehicle 11 could be a ship, boat, submarine vehicle, aircraft, land craft, space craft, or any other powerplant, either effectively or integrally connected to said minesweeping device. As a matter of fact, if the circumstances so warranted, it could be a human being or other animal swimming or walking, etc., in and/or on the ambient environmental medium. Nevertheless, in this particular preferred embodiment, tractor vehicle 11, without limitation, will be considered as being an aircraft of the helicopter variety; hence, it will be a pulling or towing type vehicle.

Tractor vehicle 11 is connected by means of tow cables 13, 15, 17, and 19 to an acoustic-magnetic energy generator 21 in such manner as to tow it as a unitary device. In actual practice, however, cables 13 and 15 may be two different sections of a single combination insulated electrical conductor and mechanical cable which is used for the dual purpose of pulling generator 21 through its environmental medium and supplying electrical energy to the acoustical generator portion thereof from an electrical power supply preferably located within said tractor vehicle 11.

Figure 2:
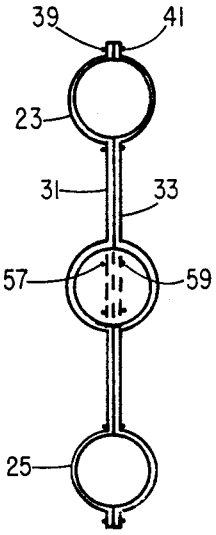
FIG. 2 illustrates a right (rear) end view of the acoustic-magnetic generator portion of the system of FIG. 1.

Acoustic-magnetic generator 21 contains a pair of closed ended, permanently magnetized metal pipes 23 and 25 which are spatially disposed and held by a pair of rigid straps 27 and 29 at the front end thereof and another pair of straps 31 and 33 at the rear end thereof, as best seen in both FIGS. 1 and 2.

Said pipes 23 and 25 should, of course, be designed to have whatever buoyancy is necessary to make generator 21 float on the surface of water, float at some subsurface level in water, or maintain whatever position is desired for making the entire operation operate in an optimum manner, regardless of the environmental medium or conditions. Thus, for instance, if it is desired to move generator 21 along the surface of the ground (or sea floor), wheels may be installed thereon to facilitate so doing; or, in the alternative, attitude, guidance, and position controls and/or buoyancy materials or devices may be added thereto, or included as appropriate therein, in the event some predetermined subaqueous, atmosphere, or space position happens to be the ambient environment during any given operational situation.

Moreover, pipes 23 and 25 may be designed to have any desired geometrical configuration and be made of any material or materials that can be magnetized. As an alternative, they could be designed to be solenoids, i.e., wooden cores with wire wrapped around them in such manner as to produce electromagnetic fields when electric current is passed through the wire.

In addition, for purposes of making generator 21 mobile, it may be combined with a tractor vehicle, as previously indicated, or it may incorporate any suitable internal or external power plant in such manner as to be self-contained, self-propelled, and self-sufficient.

Obviously, it would be well within the purview of the artisan having the benefit of the teachings presented herewith to make whatever design choices are necessary to make the subject invention operate in any desired situation.

Straps 27, 29, 31, and 33 are preferably bent to conform to the external configuration of pipes 23 and 25, respectively, as is best seen in FIG. 2. Straps 27 and 29 are held together by a plurality of bolts 35 extending through holes therein that are secured by a like plurality of nuts 37. Straps 27, 29, 31, and 33, along with their respectively associated bolts 35, 37, 39 and nuts 41 effectively clamp pipes 23 and 25 in predetermined spatial dispositions relative to each other and relative to an acoustical energy generating pipe 43 of any desired geometrical configuration mounted therebetween.

Acoustical pipe 43 has a front hinge 45 connected to the front end thereof, as by welding 47 or other suitable means. The front end of hinge 45 is preferably inserted between straps 27 and 29 and bolted thereto by means of a plurality of bolts 49 and nuts 51, as best seen in FIG. 1. Nevertheless, it should be understood that any other connection means, such as welding or the like, may be substituted for said nuts and bolts, if so desired.

The rear end of acosutic pipe 43 is likewise effectively connected to the aforesaid rear straps 31 and 33 by means of a rear hinge 53, the front portion of which is attached by means of a weld 55 to the rear end thereof, and the rear portion of which is preferably inserted between straps 31 and 33 and held there by a plurality of bolts 57 and nuts 59, or any other suitable conventional means as best seen in FIG. 2.

Figure 3:
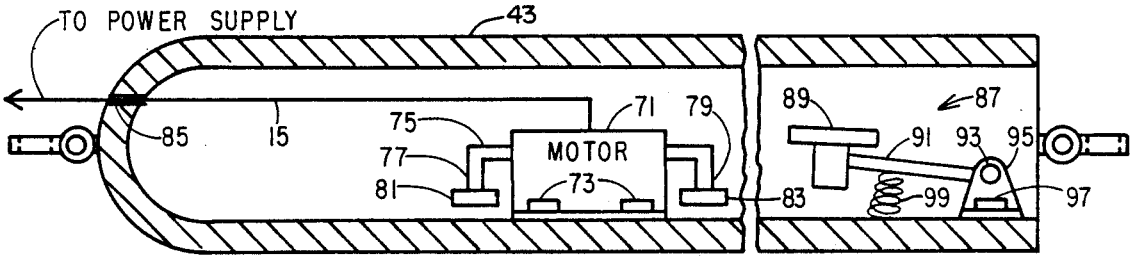
FIG. 3 shows a combination cross-section and schematic view—with some parts broken away—of the middle acoustical generator portion of the invention shown in FIG. 1.

Referring now to FIG. 3, a cross-sectional view of acoustic pipe 43 is shown with the parts similar to those shown in FIG. 1 having similar reference numerals, and with newly mentioned elements having new reference numerals.

At the outset, it should be understood that the length of acoustic pipe 43—and the respective lengths of pipes 23 and 25, for that matter—may be designed to provide whatever resonance frequency or other characteristics as would be desirable therefor. Also, acoustic pipe 43 may be made of any number of materials, such as plastic, steel, fiberglass, or rubber, even though it is disclosed herewith and in FIG. 3 as being metal.

Mounted within pipe 43 is an electric motor 71, with the mounting thereof being implemented by any suitable conventional manner, say, as by a plurality of bolts 73. Motor 71 contains a rotating shaft 75 which extends out of each side thereof, upon which is attached, integrally or otherwise, a pair of eccentrics or cranks 77 and 79 which, in turn, have a pair of predetermined weights 81 and 83 connected to the ends thereof, respectively.

To provide electrical energy thereto, motor 71 is electrically connected to an appropriate supply thereof by means of the aforementioned insulated electrical cables 13 and 15 or any other conventional electrical wire arrangement. Of course, since the subject invention is primarily intended for being used in water, wire portion 15 extends through the front wall of pipe 43 in such manner that a watertight seal will be provided thereat. Hence, a packing gland 85, or the like, may be used for such purpose.

As a general rule, motor 71 and its associated eccentrically mounted weights are located at the center of the length of pipe 43, so that, for most practical purposes, only a balanced force will be applied thereto and substantially no longitudinal axis tilt will be effected thereby. However, it should be understood that, if circumstances so require, it may be located anywhwere within pipe 43 that will provide optimum operation therefor.

A clapper assembly 87 has a hammer 89 connected to one end of an arm 91, the other end of which is connected to a shaft 93 for rotation thereon. Shaft 93 is mounted in any suitable support bracket 95 which, in turn, is attached to the inside surface of pipe 43 in such manner, say, by bolts 97, that adequate movement of said hammer 89 will permit it to clang thereagainst. A spring 99 of suitable spring rate is conventionally disposed between the inside surface of pipe 43 and the aforesaid arm 91, so as to effectively urge hammer 89 away from the inside surface of pipe 43 but still permit it to strike it when forced by momentum in the direction thereof as a result of certain movement of said pipe 43, as will be explained more fully subsequently.

Figure 4:
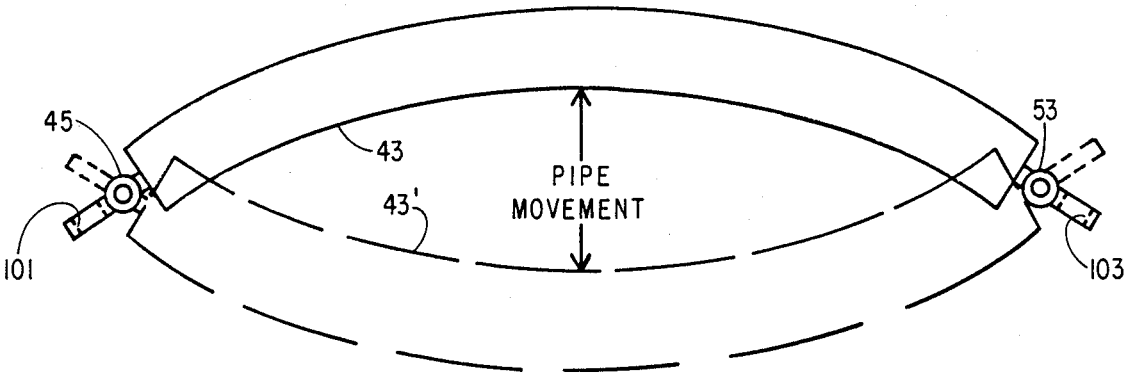
FIG. 4 is an exaggerated disclosure of the movement of the center acoustical pipe when it is caused to move by the rotation of the motor driven eccentric weights depicted in FIG. 3.

At this time, it may be noteworthy that the entire assembly constituting acoustic-magnetic generator 21 is preferably rigidly and firmly constructed; however, due to the bending movement of acoustic pipe 43 as shown in FIG. 4., the distance between hinges changes slightly. Of course, the amount of bending of pipe 43 shown in FIG. 4 is a considerable exaggeration, in order to more easily prove a point. Therefore, when pipe 43 moves or bends to the imagionary position 43' from its portrayed top position, the distance therebetween changes from a minimum—to a maximum—to a minimum, and so on and so forth, when pipe 43 is being vibrated. Ordinarily, even though the assembly of generator 21 is rigid to a considerable extent, there is enough flexibility therein to permit the proper bending of said acoustic pipe 43 during the vibration thereof to broadcast acoustical energy through the ambient environment-aqueous or otherwise—thereof. But, in the even greater flexibility is required for any given frequency of operation, holes 101 and 103(shown only in FIG. 4) through which bolts 49 and bolts 57 respectively pass in the front and rear portions of hinges 45 and 53 may be elongated in the longitudinal direction. Again, such elongation is strictly optional, depending on other construction requirements and operational circumstances.

Figure 5:
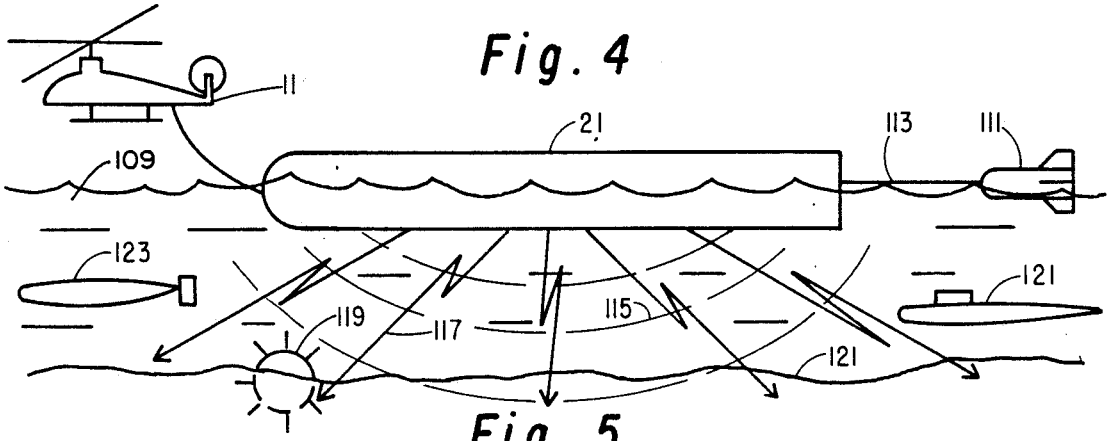
FIG. 5 illustrates the subject invention being used within a representative marine environment for the purpose of sweeping mines deployed therein.

FIG. 5 illustrates one representative use of the instant invention. Disclosed therein is acoustic-magnetic generator 21 being towed by a helicopter type tractor vehicle 11 (more generally characterized in FIG. 1 as an aircraft). In this case, it is being towed on the surface of water 109, with a stabilizer device 111 being towed behind it by means of a cable 113 extending from the rear end thereof. Of course, stabilizer 111 and cable 113 are optional, too, since their use would be determined by operational circumstances and perhaps ambient medium conditions, such as sea state and the like.

As generator 21 is towed along a predetermined course or path by helicopter 11, acoustical energy 115 of a given frequency emanates therefrom, along with magnetic energy 117. Thus, as may readily be seen, both of said energies travel through one or more environmental mediums within the broadcast range thereof—in this instance, water, sea floor, and the atmosphere. During such travel, acoustic, magnetic, and/or acoustic—magnetic marine mines, such as mine 119, are acquired by said acoustical and magnetic energies and neutralization thereof is effected as a consequence thereof, as will be explained more fully below during the discussion of the operation of the invention.

Of course, as would be obvious to the artisan, the device portrayed as mine 119 could be any other object or device that would be actuated in some way in response to sonic and/or magnetic energy of the frequencies produced by this invention, including a submarine boat 121 or torpedo 123. And, accordingly, the utility of the invention would be increased as a result thereof.

MODE OF OPERATION

The operation of the subject invention is very simple and will now be discussed briefly in conjunction with all of the figures of the drawing.

As generator 21 is towed along a given path or course for the purpose of sweeping any magnetic and/or acoustic mines deployed therealong, pipes 23 and 25 broadcast magnetic energy throughout the water ambient thereto. At the same time, motor 71 is electrically energized and caused to run at the resonant frequency of acoustic pipe 43. Hence, the unbalance of eccentrically rotated weights 81 and 83 sets up a moment of inertia in pipe 43, causing it to bob up and down in the water. Such bobbing up and down generates very low frequency pressure energy waves having an acoustic frequency of, say, 2 to 5 cycles per second, as a result of acoustic pipe 43 bending and vibrating about hinges 45 and 53 at the extremities thereof in the manner represented in FIG. 4.

In the event, enhancement of the power of the vibration of pipe 43 is necessary or desired, it may be accomplished by incorporating clapper assembly 87 in the invention. Thus, when pipe 43 bobs up and down—that is, vibrates—as a result of the rotation of motor driven eccentric weights 81 and 83, the momentum of hammer 89 overcomes the resistance of spring 99 and clangs down against the inside surface of pipe 43, causing it to "ring" in accordance with its resonant frequency and in concert with its bobbing up and down. Of course, as implied above, by changing the size (and materials) of pipe 43 and the speed of motor 71, any relatively low frequency can be produced between, for example, 2 Hz and 250 Hz at a fairly high power. Naturally, the proper design thereof would make it possible to broadcast much higher frequency acoustical signals, too, although that is not the primary intent in this particular case. Nevertheless, due to the cavitation produced by the vibration and the ringing of pipe 43 sufficient sonic energy is produced at frequencies higher than 250 Hz to satisfy the response requirements of mines and other devices.

Thus, as is best seen in FIG. 5, acoustical energy 115 of predetermined frequency and magnetic energy 117 travel through water 109—and perhaps sea floor 121—to impact upon marine mine 119, thereby causing it to self-destruct in response thereto. Consequently, all of such mines are effectively neutralized, making the water course above them safe for shipping or the traverse of other marine or submarine vehicles.

In addition, it would appear to be noteworthy that magnetized pipes 23 and 25 are also subjected to the acoustical vibration produced by pipe 43; hence, they, too, may, on occasions, vibrate in such manner as to effectively produce varying or alternating magnetic fields. Of course, such varying or alternating magnetic fields could also be generated if said magnetized pipes 23 and 25 were replaced by solenoid coils powered by an alternating current source.

In addition to mine neutralization, the subject invention may be used to decoy other devices containing equipment that responds to or homes in on magnetic or sonic energies or both. For instance, two of such devices could be submarine 121 and torpedo 123, since both could be diverted and/or decoyed from their intended courses or purposes as a result of the presence of acoustic and/or magnetic energy being present within their ambient environments which is sensed thereby.

In view of the foregoing, it may readily be seen that the subject invention constitutes a new and unique combination of elements which, in turn, constitutes an advancement in the acoustic-magnetic generator art and, therefore, makes a contribution of considerable significance to the field of mine sweeping.

What is claimed is:

1. A minesweeping system, comprising in combination:

means for generating and broadcasting a predetermined magnetic field throughout a given environmental medium;

means for generating and broadcasting acoustical energy of predetermined frequency throughout the aforesaid given environmental medium;

holding means connected to said predetermined magnetic field generating and broadcasting means and to the aforesaid acoustical energy generating and broadcasting means for the holding thereof in such predetermined spatial dispositions that the magnetic field and acoustical energy respectively broadcast thereby comingle throughout said given environmental medium during the broadcasts thereof;

said holding means comprising a first substantially rigid strap means connected to said predetermined magnetic field generating and broadcasting means adjacent the front end thereof and extending substantially normally from the longitudinal axis thereof, a second substantially rigid strap means connected to said predetermined magnetic field generating and broadcasting means adjacent the rear end thereof and extending substantially normally from the longitudinal axis thereof in substantially the same plane as the aforesaid first strap means, a first hinge means connected between said second substantially rigid strap means and the front end of the aforesaid acoustical energy generating and broadcasting means, and a second hinge means connected between said second substantially rigid strap means and the rear end of said acoustical energy generating and broadcasting means.

2. The invention of claim 1, further characterized by means effectively connected to said predetermined magnetic field and acoustical energy generating and broadcasting means for effecting the movement thereof along a predetermined course within a predetermined environmental medium.

3. A minesweeping system, comprising in combination:

a first magnetized pipe means;

a second magnetized pipe means;

means connected adjacent the front ends of said first and second magnetized pipe means for the holding of the front ends thereof in first predetermined spatial dispositions relative to one another;

means connected adjacent the rear ends of said first and second magnetized pipe means for the holding of the rear ends thereof in second predetermined spatial dispositions relative to one another;

an acoustical energy generating means disposed between the aforesaid first and second magnetized pipe means;

a first hinge means connected between the aforesaid first and second pipe means front end holding means and the front end of said acoustical energy generating means; and a second hinge means connected between the aforesaid first and second pipe means rear end holding means and the rear end of said acoustical energy generating means.

4. The device of claim 3, wherein said acoustical energy generating means disposed between the aforesaid first and second magnetized pipe means comprises:

a pipe having predetermined buoyancy characteristics;

a motor having a rotatable shaft extending therethrough;

a pair of eccentric cranks respectively connected to opposite ends of the shaft of said motor; and a pair of weights respectively connected to the outer extremeties of said pair of eccentric cranks.

5. The device of claim 3, wherein said acoustical energy generating means disposed between the aforesaid first and second magnetized pipe means comprises:

a pipe having predetermined buoyancy charcteristics;

a motor having a rotatable shaft extending therethrough;

a pair of eccentric cranks respectively connected to opposite ends of the shaft of said motor; and a pair of weights respectively connected to the outer extremities of said pair of eccentric cranks.

a bracket connected to the inside surface of said pipe;

a shaft connected to said bracket;

a movable arm, with one end thereof connected to said shaft for rotation thereon;

a hammer connected to the other end of said movable arm; and a spring connected between the inside surface of said pipe and the aforesaid movable arm for resiliently urging the latter from the former but permitting the aforesaid hammer to strike the inside surface of said pipe as a consequence of predetermined movement thereof.

6. The invention of claim 3, further characterized by means effectively connected to said first and second magnetized pipe means and said acoustical energy generating means for effecting the moving thereof along a predetermined course within a predetermined environment.

* * * * *